United States Patent [19]

Stephens

[11] Patent Number: 5,042,109

[45] Date of Patent: Aug. 27, 1991

[54] HEIGHT ADJUSTMENT MECHANISM

[75] Inventor: Paul D. Stephens, Cleveland Heights, Ohio

[73] Assignee: Royal Appliance Mfg. Co., Cleveland, Ohio

[21] Appl. No.: 464,165

[22] Filed: Jan. 12, 1990

[51] Int. Cl.[5] ..... A47L 5/34

[52] U.S. Cl. ..... 15/354; 15/333

[58] Field of Search ..... 15/354, 355, 356, 359, 15/360, 333

[56] References Cited

U.S. PATENT DOCUMENTS

| | | | |
|---|---|---|---|
| 1,856,136 | 5/1932 | Orr | 15/355 X |
| 2,067,990 | 1/1937 | Taylor | 74/155 |
| 2,146,602 | 2/1939 | Spooner | 15/354 |
| 2,167,785 | 8/1939 | Taylor | 15/358 |
| 2,289,711 | 7/1942 | Kirby . | |
| 2,379,316 | 6/1945 | Osborn | 15/358 |
| 2,691,792 | 10/1954 | Humphrey | 15/333 |
| 2,734,219 | 2/1956 | Kaufman | 15/333 X |
| 3,217,351 | 11/1965 | Hayba | 15/333 X |
| 3,654,661 | 4/1972 | Scott | 15/354 X |
| 3,683,448 | 8/1972 | Lagerstrom et al. | 15/354 |
| 3,713,185 | 1/1973 | Clowers et al. | 15/354 |
| 3,848,292 | 11/1974 | Nordeen et al. | 15/354 X |
| 4,199,839 | 4/1980 | Martinec | 15/354 |
| 4,437,205 | 3/1984 | Koland | 15/354 |
| 4,446,594 | 5/1984 | Watanabe et al. | 15/354 X |
| 4,782,552 | 11/1988 | Bartlett et al. | 15/354 X |

FOREIGN PATENT DOCUMENTS

| | | | |
|---|---|---|---|
| 952663 | 8/1974 | Canada | 15/354 |
| 716150 | 5/1952 | United Kingdom . | |

*Primary Examiner*—Chris K. Moore

*Attorney, Agent, or Firm*—Fay, Sharpe, Beall, Fagan, Minnich & McKee

[57] ABSTRACT

The vacuum cleaner includes a carriage having front and rear support members rotatably carried by the carriage for movably supporting the carriage on a subjacent surface as well as a floor cleaning nozzle generally horizontally disposed adjacent a front support member of the vacuum cleaner. A first movable element is provided on the carriage for selectively adjusting the height of the nozzle in relation to the subjacent surface. A second movable element is positioned on the carriage and is operatively connected to the first movable element for adjusting a position of the first movable element. A third movable element is operatively connected to the second movable element and is also connected on the carriage for adjusting a position of the second movable element. The third movable element includes a rocker pedal which can be adjusted between a plurality of positions.

18 Claims, 3 Drawing Sheets

HEIGHT ADJUSTMENT MECHANISM

BACKGROUND OF THE INVENTION

This invention relates to appliances used for floor cleaning and the like. More specifically, the present invention relates to a means for adjusting the disposition of a vacuum cleaner carriage relative to a floor surface.

Vacuum cleaners of the floor cleaning or upright type generally include a chassis having a nozzle on a lower surface of a front end thereof through which nozzle air is sucked by an air moving motor-blower unit. A rotary brush is mounted adjacent the nozzle for contacting the floor surface to agitate and loosen the dirt so that it may be sucked free of the surface. Wheels or other supports are rotatively mounted at the front and rear of the chassis for supporting the cleaner in a rolling manner on the floor. These vacuum cleaners are called upon to clean many different kinds of modern floor coverings varying in pile thickness from the short outdoor or patio type carpeting to the long deep shag type. In order to clean these various floor surfaces effectively, it is known to vary the vacuum cleaner's nozzle height to locate the nozzle at a proper level above the surface to provide the required suction for the particular type of floor covering or surface being cleaned and to position the brush at the proper height.

While many types of nozzle height adjusting mechanisms are known to the art, the known mechanisms are relatively complex and include a large number of parts because many nozzle heights are necessary to handle the different kinds of modern floor coverings available. The inherent multiplicity of such parts has made it more expensive to manufacture and assemble an upright vacuum cleaner.

There are also times when it is necessary to lift the rotating brush away from the floor surface while the vacuum cleaner continues to run. This occurs when the user leaves the vacuum cleaner at one location while using an off the floor cleaning attachment. If the brush were to be left on the floor surface in such a situation, it might cause excessive wear, on e.g. carpeting, at that location. Also, unnecessary strain on the motor might result.

Numerous lift off mechanisms have therefore been developed to move the rotating brush away from the floor surface when desired. Those mechanisms which are mechanically coupled to the movement of the vacuum cleaner's handle employ mechanically complicated linkages. Locking arrangements meant to keep the brush away from the floor surface while the handle is in the upright position add yet further complexity to the system.

Accordingly, it has been considered desirable to develop a new and improved vacuum cleaner height adjusting mechanism and nozzle lift off mechanism which are mechanically simple, compact, durable in nature and which overcome the foregoing difficulties and others while providing better and more advantageous overall results.

BRIEF SUMMARY OF THE INVENTION

In accordance with the present invention, a new and improved vacuum cleaner is provided.

More particularly in accordance with the invention, the vacuum cleaner comprises a carriage including front and rear support means rotatively carried by the carriage for movably supporting the carriage on a subjacent surface and a floor cleaning nozzle generally horizontally disposed adjacent the front support means of the vacuum cleaner. A first movable means is positioned on the carriage for selectively adjusting the height of the nozzle in relation to the subjacent surface. A second movable means is positioned on the carriage and is operatively connected to the first movable means for adjusting a position of the first movable means. A third movable means is operatively connected to the second movable means and is also positioned on the carriage for adjusting a position of the second movable means. The third movable means comprises a rocker pedal which can be adjusted between a plurality of positions.

According to another embodiment of the present invention, a vacuum cleaner nozzle height adjustment mechanism is provided for a vacuum cleaner having a housing defining an air suction passage, rear wheels for supporting a rear portion of the housing and a front roller for supporting a front portion of the housing, including a nozzle, for rolling movement over a surface to be cleaned.

In accordance with this aspect of the invention, the vacuum cleaner height adjustment mechanism comprises a front axle for rotatably journaling the front roller and a link member secured to the front axle. A lever is slidably mounted in the housing with the lever having a distal end, on which are defined a plurality of cam surfaces that cooperate with the link member, and a proximal end. A manually movable means to which the proximal end of the lever is secured, is provided for longitudinally moving the lever. The manually movable means is accessible from an exterior periphery of the housing.

In accordance with yet another aspect of the invention, an appliance height adjustment mechanism is provided.

More particularly in accordance with this aspect of the invention, the appliance height adjustment mechanism comprises an appliance carriage including front and rear support elements rotatably carried by the carriage so that the appliance is movably positioned on a support surface. A front axle is provided including a first portion for journaling a front support element, a second portion journaled on the carriage and a third or arm portion. A linkage is positioned on the carriage and cooperates with the front axle third portion for selectively adjusting the height of a front end of the appliance in relation to the support surface. A manually operated control is operatively connected to the linkage and is also positioned on the carriage for adjusting the linkage.

One object of the present invention is the provision of a new and improved appliance height adjustment mechanism.

Another advantage of the present invention is the provision of a vacuum cleaner nozzle height adjustment mechanism that is extremely simple and economical in construction while yet providing an improved positive adjustment of nozzle height.

Still another advantage of the present invention is the provision of a vacuum cleaner nozzle height adjustment mechanism that can be readily adjusted for different pile heights by simply rotating a rocking pedal between a plurality of positions.

Yet another advantage of the present invention is the provision of a vacuum cleaner nozzle height adjusting mechanism that includes a linkage arm having a plurality of cam surfaces located on its distal end so that a longitudinal movement of the lever shifts a point of engagement of the arm to one of the cam surfaces thereby varying a height of the nozzle.

Still yet another advantage of the present invention is a vacuum cleaner nozzle height adjustment mechanism including stop means located at either end of a movement path of the mechanism and a locking means for holding the mechanism in a selected position.

A further advantage of the present invention is the provision of a vacuum cleaner brush lift-off mechanism which employs some of the structure of the nozzle height adjusting mechanism so as to provide a simple and economical design.

A yet further advantage of the present invention is the provision of a vacuum cleaner brush lift-off mechanism which is actuated when a handle of the vacuum cleaner is pivoted to its upright position.

Still other advantages of the present invention will become apparent to those skilled in the art after a reading and understanding of the following detailed specification.

BRIEF DESCRIPTION OF THE DRAWINGS

The invention may take physical form in certain parts and arrangements of parts a preferred embodiment of which will be described in detail in this specification and illustrated in the accompanying drawings which form a part hereof and wherein.

DETAILED DESCRIPTION OF THE PREFERRED EMBODIMENT

Figure 1:
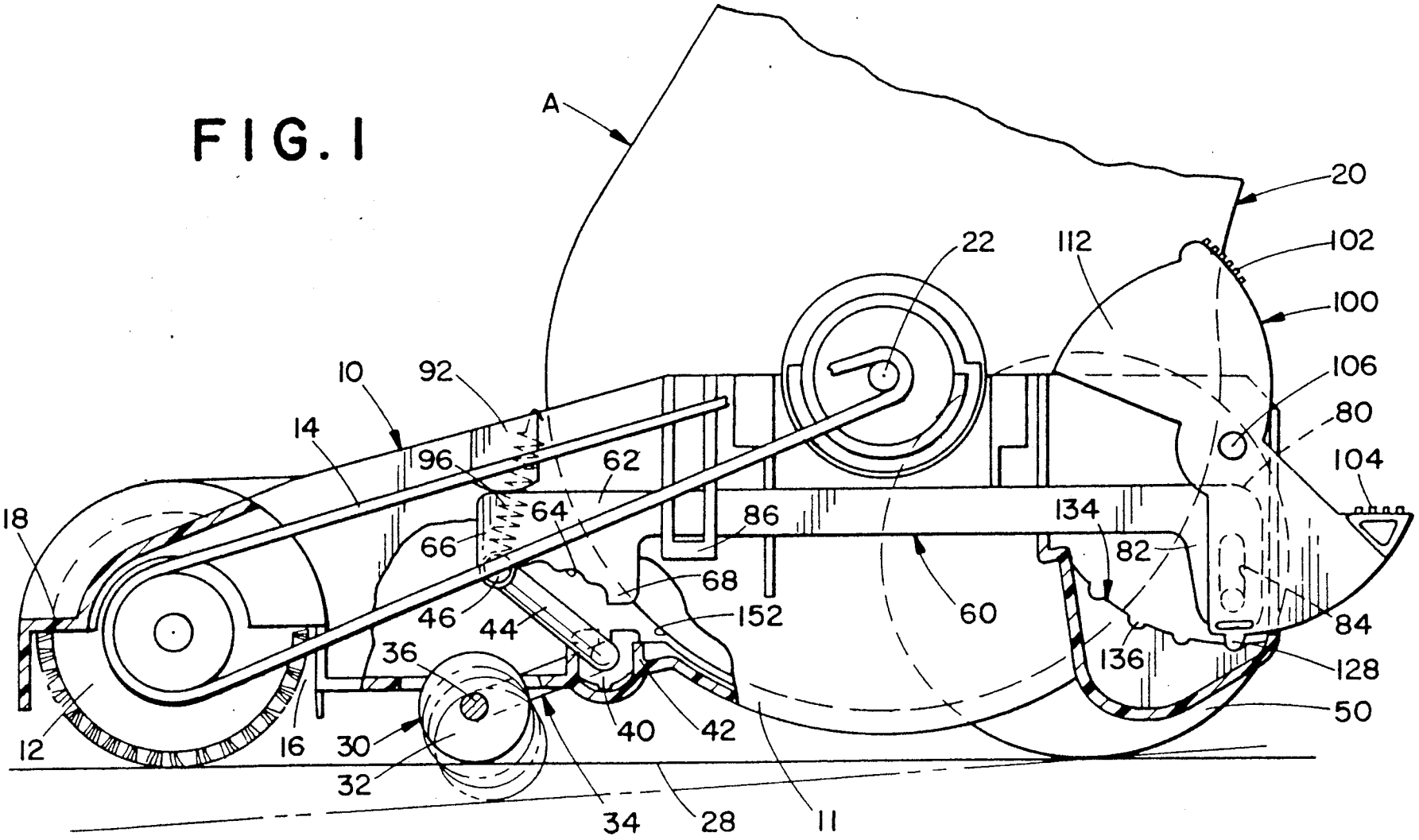
FIG. 1 is a side elevational view, with certain parts broken away for clarity, of a vacuum cleaner having a height adjustment mechanism, including a nozzle height adjusting structure and a brush lift-off mechanism, according to the preferred embodiment of the present invention.

Referring now to the drawings, wherein the showings are for purposes of illustrating a preferred embodiment of the invention only and not for purposes of limiting same, FIG. 1 shows the preferred embodiment of the subject new appliance height adjusting mechanism. While the mechanism is primarily designed for, and will hereinafter be described for use with an upright vacuum cleaner A, it will be appreciated that the overall inventive concept involved could be adapted for use in many other appliance environments as well.

More particularly, the vacuum cleaner A has a carriage 10 which supports a rotary brush 12 that is driven by a belt 14 and positioned in a suction mouth 16 located at a front end of the carriage on a bottom face thereof. The carriage further includes a housing 18 which encloses an upper part of the rotary brush 12 as well as the belt 14. Rotatably secured to the carriage 10 is a vacuum cleaner body 20 including a handle portion (not visible). Supporting the carriage 10 on an adjacent floor surface 28 in a movable manner is a front support means 30 including a roller 32 rotatably secured on a front axle 34.

Figure 2:
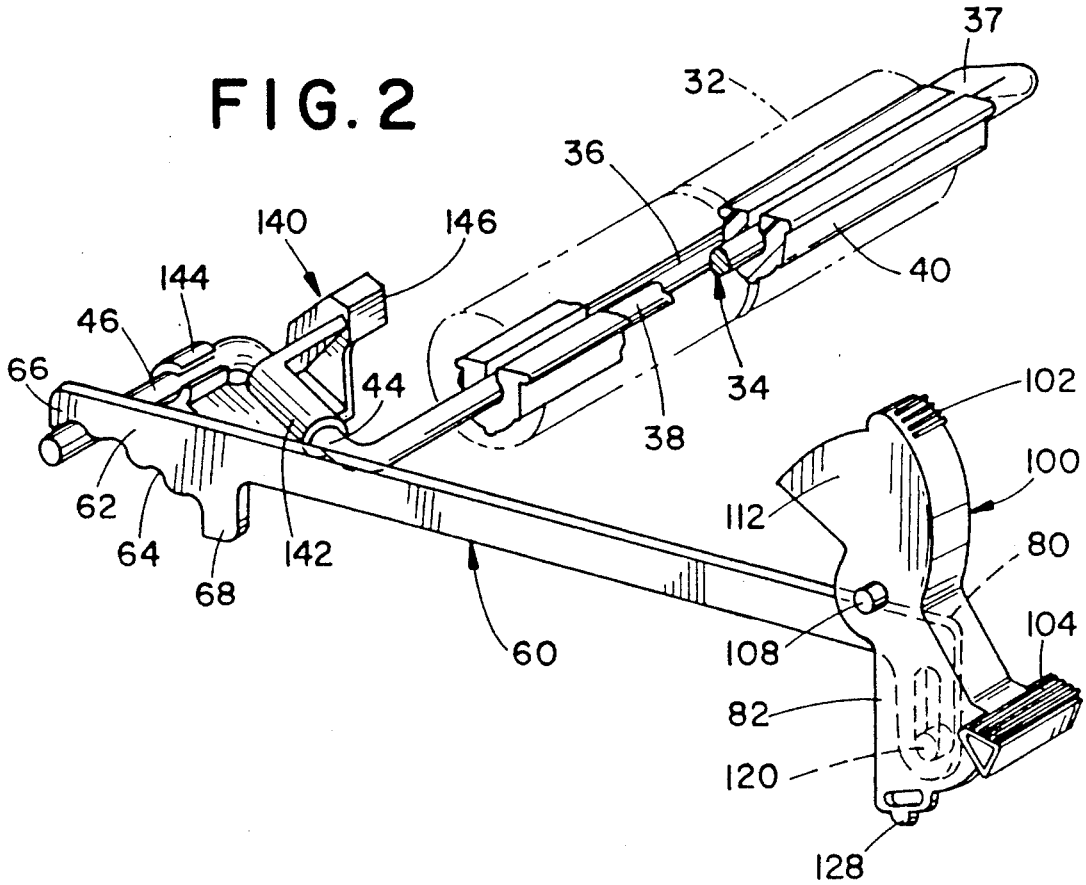
FIG. 2 is a perspective view of the nozzle height adjusting structure of FIG. 1.

With reference now also to FIG. 2, the front axle includes a first or axle portion 36, a second or connecting portion 37 and a third or journaling portion 38. The third portion 38 journals the front axle 34 in a bracket 40. The bracket is secured in a U-shaped channel 42 of the carriage housing 18. The front axle 34 further comprises a fourth portion 44 which is offset from the third portion 38 as well as fifth or arm portion 46 which is oriented normal to the fourth portion.

As shown in FIG. 1, rotatably supporting a rear section of the vacuum cleaner carriage 10 is a rear support means which includes at least one wheel 50. Cooperating with the arm portion 46 of the front support means 30 is a lever 60 having a distal end 62 on which are provided a plurality of cam surfaces 64. Preferably, four such cam surfaces are provided although it should be recognized that any other suitable number of cam surfaces can be provided, depending upon the number of desired heights of the vacuum cleaner suction mouth 16. The cam surfaces are located at different effective heights so that movement of the lever 60 longitudinally serves to shift a point of engagement of the lever cam surface with the front axle arm portion 46 thereby varying the height of the carriage suction mouth 16.

Provided on respective ends of the cam surfaces 64 are first and second stop surfaces 66 and 68 which respectively prevent a motion of the lever 60 both forward and to the rear past preselected points.

A proximal end 80 of the lever 60 includes a flange section 82 having near a free end thereof a through aperture 84. A first means 86 is provided on the carriage housing for slidably supporting the lever with the first means preferably comprising a U-shaped bracket. A second means 92 is provided on the housing in a spaced manner from the first means for preventing an upward movement of the distal end 62 of the lever. The second means can comprise simply a downwardly facing protrusion located on an inner face of the carriage housing 18, as is illustrated.

A biasing means 96, such as a spring, biases the arm 46 toward the cam surfaces 64. The spring is useful in holding the front axle 34 in the preselected position even when the vacuum cleaner A is lifted from the floor surface 28. One end of the spring is secured to the arm 64 and the other end is secured to the carriage 10.

Cooperating with the lever 60 is a rocker pedal 100 having a first contact surface 102 and, spaced therefrom, a second contact surface 104. The first and second spaced contact surfaces 102 and 104 respectively rotate the pedal in a clockwise and a counterclockwise direction thereby moving the lever 60 longitudinally forward and to the rear, thus putting different cam surfaces 64 thereof in contact with the front axle arm portion 46.

Figure 3:
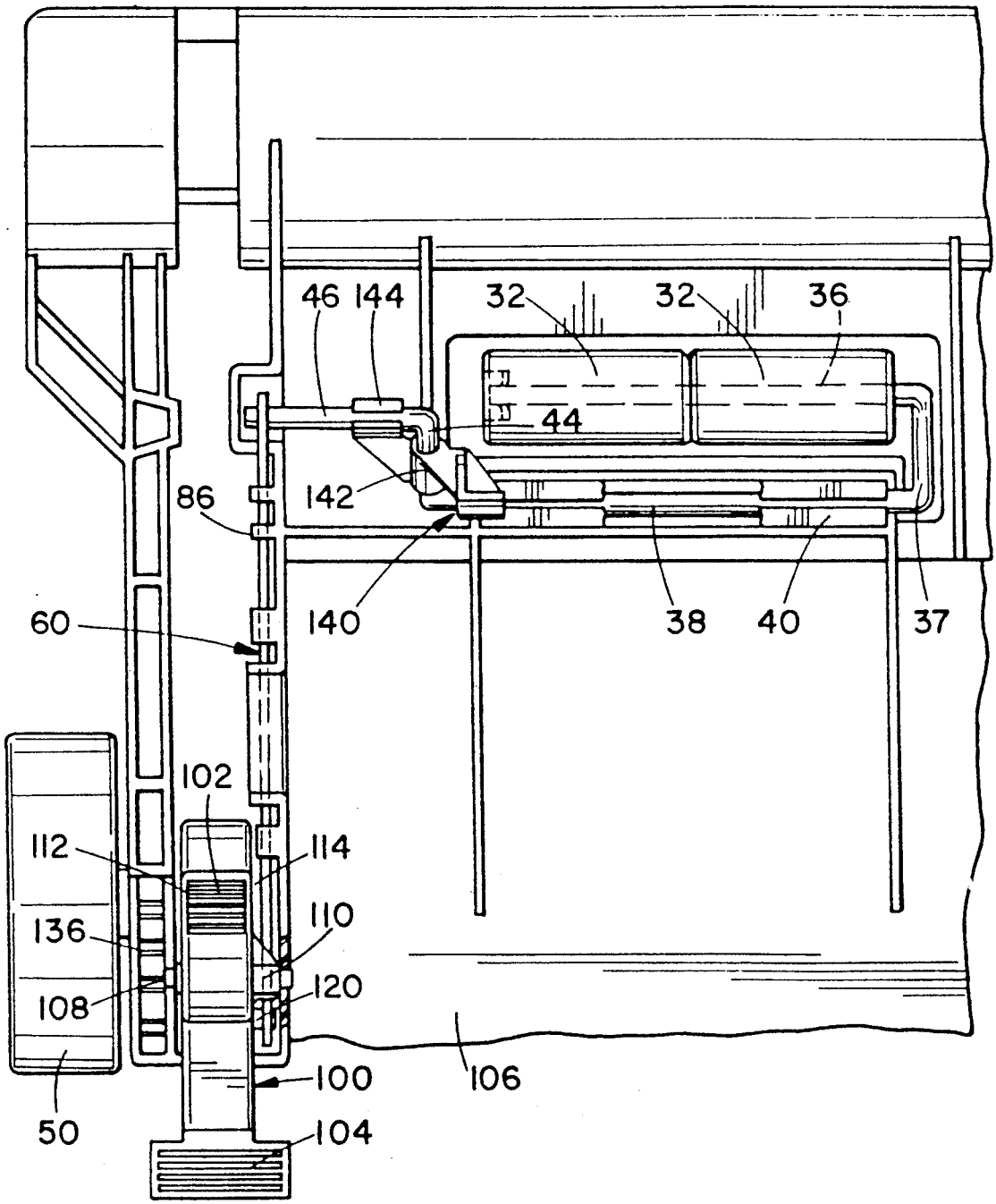
FIG. 3 is a top plan view of the vacuum cleaner of FIG. 1 with certain parts broken away for clarity; and, FIG. 4 is a side elevational view, with certain parts broken away, of a brush lift-off mechanism of the vacuum cleaner of FIG. 1.

As is best shown in FIG. 3, the rocker pedal 100 is pivotable about an axis 106 defined by a pair of stubs 108, 110 extending from opposing side surfaces 112, 114 of the pedal 100. Also extending away from the second side surface 114 is a stub 120 which is adapted to engage the lever aperture 84 thereby interconnecting the rocker pedal 100 with the lever 60.

Figure 4:
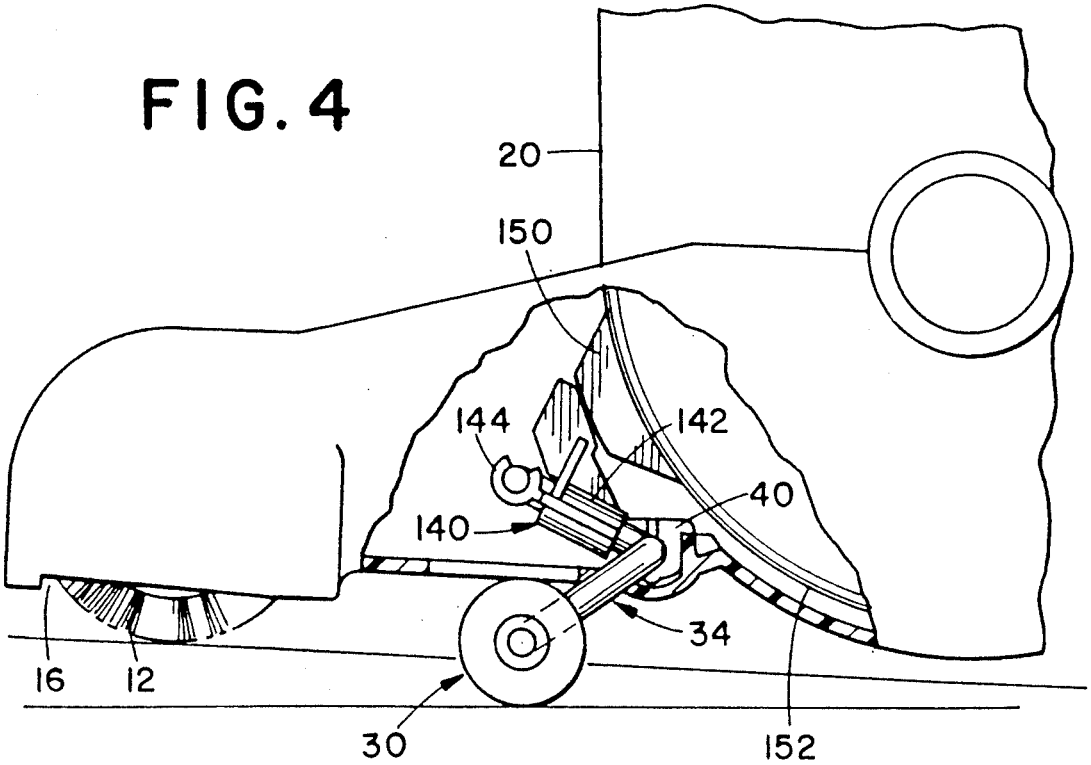

With particular reference now to FIG. 4, the nozzle height adjusting mechanism also includes a brush lift-off mechanism. For this purpose the axle member 34 has secured thereto an arm 140. More particularly, the arm 140 is provided with clips 142 and 144 which enable the arm to be secured to the third 38 and fourth 44 portions, respectively, of the axle member 34. Cooperating with a contact face 146 of the arm 140 is a protrusion 150 located on and extending away from a barrel shaped lower surface 152 of the body 20.

The body s rotated by the operator grasping the handle (not visible) of the vacuum cleaner. When the handle is brought into the upright position, the protrusion 150 will contact the arm 140. This will lead to a rotation of the front axle 34 as the third portion 38 rotates in the bracket 40. That in turn will lead to the lifting away of the suction mouth 16 and the rotating brush 12 from the adjacent floor surface. It should be noted that the brush lift-off feature will override whatever nozzle height setting had been selected by the cooperation of the lever cam surfaces 64 with the front axle arm 46. When the handle is again tilted back away from the vertical, the nozzle height adjusting assembly will return to whatever its previous setting was.

Extending away from a lower periphery of the pedal first sidewall 112 is a somewhat resilient nib 128 which cooperates with a detent surface 134 provided on the carriage housing 18. The detent surface 134 preferably comprises a plurality of detents 136. It should be appreciated that the number of detents 136 should be identical to the number of cam surfaces 64 provided on the lever. In this way, each of the heights of the vacuum cleaner suction mouth 16 that are allowed by the cam surfaces 64 can be secured by location of the rocker pedal nib 128 in the suitable detent 136 corresponding thereto. As mentioned, preferably four cam surfaces are provided and accordingly, four detents 136 are also provided to allow the vacuum cleaner height to be adjusted to four separate positions. It should be noted that the spring 96 maintains the pedal position without the nib 128 and detents 136 at the pedal. The detents and nib are only needed because of the nozzle lift-off feature.

It should be clear that a simple and inexpensive nozzle height adjusting mechanism comprising a minimum number of parts has been disclosed in this application. While the invention has been described with reference to a preferred embodiment, obviously alterations and modifications will occur to others upon a reading and understanding of this specification. It is intended to include all such modifications and alterations insofar as they come within the scope of the appended claims or the equivalents thereof.

What is claimed is:

1. A vacuum cleaner comprising:

a carriage including a rear support means rotatably carried by said carriage for movably supporting said carriage on a subjacent surface;

a floor cleaning nozzle generally horizontally disposed adjacent a front end of the vacuum cleaner;

a first movable means, positioned on said carriage, for selectively adjusting the height of said nozzle in relation to the subjacent surface, wherein said first movable means comprises a front axle and rotatably journaled thereon is a front support means;

a second movable means comprising a link member which is positioned on said carriage and operatively connected to said front axle, for adjusting a position of said front axle;

a third movable means, which is operatively connected to said second movable means and is also positioned on said carriage, for adjusting a position of said second movable means, said third movable means comprising a pedal, said pedal being operatively connected to said link member;

a handle structure rotatably mounted on said carriage;

a first arm connected to said front axle; and, a protrusion located on a barrel-shaped lower end of said handle structure, said first arm cooperating with said protrusion to lift said floor cleaning nozzle away from the subjacent surface when said handle structure is moved to an upright position.

2. The vacuum cleaner of claim 1 wherein said link member is mounted on said carriage so as to allow a longitudinal movement thereof and which link member includes a first end which cooperates with said front axle and a second end which is operatively connected to said pedal.

3. The vacuum cleaner of claim 2 wherein said first movable means further comprises a second arm connected to said front axle and wherein said first end of said link member includes a plurality of cam surfaces which contact said second arm, wherein said cam surfaces are located at different effective heights, movement of said link member longitudinally serving to shift a point of engagement of said link member and said second arm to one of said cam surfaces thereby varying a height of said nozzle.

4. The vacuum cleaner of claim 3 further comprising a means for biasing said first movable means second arm toward said link member cam surfaces.

5. The vacuum cleaner of claim 4, wherein said means for biasing comprises a spring.

6. The vacuum cleaner of claim 1 wherein said pedal is pivotably mounted on said carriage and comprises:

a first contact surface for pivoting said pedal in a first direction;

a second contact surface, spaced from said first contact surface, for pivoting said pedal in a second direction; and, a pivot surface, located between said first and second contact surfaces, at which said pedal is secured to said housing and around which said pedal pivots.

7. The vacuum cleaner of claim 6 further comprising a detent construction for selectively holding said pedal in a preselected position.

8. A vacuum cleaner nozzle height adjustment mechanism for a vacuum cleaner having a housing defining an air suction passage, a rear rotatable support for supporting a rear portion of the housing and a front rotatable support for supporting a front portion of the housing, including a nozzle, for rolling movement over a surface to be cleaned, comprising:

a front axle for rotatably journaling said front rotatable support;

a first link member secured to said front axle;

a second link member slidably mounted in said housing, said second link having a first end, on which are defined a plurality of cam surfaces that cooperate with said first link member, and a second end;

a pedal for moving said second link, said pedal being pivotally mounted to said housing and being accessible from an exterior periphery of said housing, and including a section to which said second end of said second link member is secured; and, a locking mechanism for selectively locking said pedal in a preselected position.

9. The mechanism of claim 8 further comprising:

a first means defined on said housing for slidably supporting said second link member; and, a second means defined on said housing for preventing an upward movement of said first end of said second link member.

10. The mechanism of claim 8 wherein said pedal includes a first contact surface for rotating said pedal in a first direction and, spaced therefrom, a second contact surface for rotating said pedal in a second direction, and wherein said pedal is pivoted about a point located between said first and second contact surfaces.

11. An appliance height adjustment mechanism comprising:

an appliance having a carriage including front and rear support elements rotatably carried by said carriage, and a handle structure rotatably secured to said carriage, said appliance being movably positioned on a support surface;

a front axle including a first portion for journaling a front support element, a second portion journaled on said carriage and a third portion;

a link member, positioned on said carriage and having a first end on which are defined a plurality of cam surfaces which cooperate with said front axle third portion, for selectively adjusting the height of a front end of said appliance in relation to said support surface wherein said link member first end comprises:

a first stop surface for preventing a motion of said link member in a first direction past a preselected point, and a second stop surface, spaced from said first stop surface, for preventing a motion of said link member in a second direction past a preselected point; and, a manually operated control, which is operatively connected to a second end of said link member and is also positioned on said carriage, for adjusting said link member.

12. The mechanism of claim 11 wherein said manually operated control comprises a pedal pivotally mounted to said housing.

13. The mechanism of claim 12 wherein said pedal comprises first and second spaced contact surfaces for rotating said pedal in a first and a second direction, respectively, and thereby moving said link member, said link member cooperating with said pedal.

14. The mechanism of claim 11 further comprising a locking mechanism for selectively locking said pedal in a preselected position.

15. The mechanism of claim 11 further comprising:

a first means defined on said carriage for slidably supporting said link member; and, a second means defined on said carriage for preventing an upward movement of said first end of said link member.

16. The mechanism of claim 11 wherein said link member provides at least two height adjustments for the appliance.

17. The mechanism of claim 11 further comprising:

an arm secured to said front axle third portion; and, a protrusion provided on a barrel-shaped lower end of said handle structure, said arm being adapted to cooperate with said protrusion to raise the front end of said appliance to its highest point when said handle structure is pivoted to an upright position.

18. The mechanism of claim 8 further comprising:

a handle structure pivotably secured to said housing;

an arm secured to said first link member; and, a protrusion provided on a barrel-shaped lower end of said handle structure, said arm being adapted to cooperate with said protrusion to raise the front portion of the housing to its highest point when said handle structure is pivoted to an upright position.

* * * * *